US009337590B2

(12) United States Patent
Wu et al.

(10) Patent No.: US 9,337,590 B2
(45) Date of Patent: May 10, 2016

(54) CABLE ELECTRICAL CONNECTOR ASSEMBLY HAVING AN INSULATIVE BODY WITH A SLOT

(71) Applicant: HON HAI PRECISION INDUSTRY CO., LTD., New Taipei (TW)

(72) Inventors: Jerry Wu, Irvine, CA (US); Xiao-Feng Li, Kunshan (CN); Jian-Jun Zhu, Kunshan (CN); Dong Tang, Kunshan (CN); Qing-Man Zhu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/340,844

(22) Filed: Jul. 25, 2014

(65) Prior Publication Data

US 2015/0031245 A1 Jan. 29, 2015

(30) Foreign Application Priority Data

Jul. 26, 2013 (CN) ..... 2013 1 0318131

(51) Int. Cl.
*H01R 25/00* (2006.01)
*H01R 13/66* (2006.01)
*H01R 13/6473* (2011.01)

(52) U.S. Cl.
CPC ..... *H01R 13/6658* (2013.01); *H01R 13/6473* (2013.01); *Y10T 29/49213* (2015.01)

(58) Field of Classification Search
CPC . H01R 13/6275; H01R 13/6335; H01R 13/26
USPC ..... 439/271, 350, 638
See application file for complete search history.

(56) References Cited

U.S. PATENT DOCUMENTS 4,737,118 A * 4/1988 Lockard ..... H01R 23/27 439/293
7,297,028 B2 * 11/2007 Daikuhara ..... G02B 6/4246 439/577
8,599,567 B2 12/2013 Wu
2009/0147493 A1 * 6/2009 Wu ..... H05K 9/0016 361/818
2011/0300735 A1 * 12/2011 Wu ..... H01R 13/6275 439/345
2011/0304996 A1 * 12/2011 Wu ..... G02B 6/4261 361/752
2012/0045920 A1 * 2/2012 Wu ..... H01R 9/032 439/345
2012/0214350 A1 * 8/2012 Wu ..... H01R 13/5812 439/676
2012/0220152 A1 * 8/2012 Wu ..... H01R 13/6335 439/350
2012/0302077 A1 * 11/2012 Wu ..... H01R 13/5213 439/135

* cited by examiner

*Primary Examiner* — Abdullah Riyami
*Assistant Examiner* — Nader J Alhawamdeh
(74) *Attorney, Agent, or Firm* — Ming Chieh Chang; Wei Te Chung

(57) ABSTRACT

A cable electrical connector assembly includes an electrical connector, a cable soldered with the electrical connector, and an insulative body. The electrical connector includes a printed circuit board having a number of conductive pads, two of the conductive pads forming a differential signal pair for differential signal transmission. The cable has a number of core wires soldered with the conductive pads. The insulative body encloses a soldering area of the conductive pads and the cable core wires. The insulative body has a slot between the two conductive pads of the differential signal pair, the slot running through the insulative body along an up-to-down direction. The slot improves impedance in the soldering area of the core wires and the conductive pads.

15 Claims, 4 Drawing Sheets

CABLE ELECTRICAL CONNECTOR ASSEMBLY HAVING AN INSULATIVE BODY WITH A SLOT

BACKGROUND OF THE INVENTION

1. Field of the Invention

The present invention relates to a cable electrical connector assembly and especially relates to a cable electrical connector assembly for high speed transmission.

2. Description of Related Art

U.S. Pat. No. 8,599,567 discloses a cable electrical connector assembly including an electrical connector and a cable connecting with the electrical connector. The electrical connector includes a printed circuit board. The cable has a number of core wires electrically connecting with conductive pads on the printed circuit board and an insulative body enclosing a region where the core wires and the conductive pads are connected. Due to solders present in areas between the core wires and the conductive pads and a higher dielectric constant of the insulative enclosing body than air, impedance increases in such areas. High frequency performance of the cable electrical connector assembly is thus affected.

An improved cable electrical connector assembly is desired.

SUMMARY OF THE INVENTION

Accordingly, an object of the present invention is to provide a cable electrical connector assembly having an improved high frequency performance.

In order to achieve the object set forth, the invention provides a cable electrical connector assembly comprising: an electrical connector comprising a printed circuit board having a plurality of conductive pads, two of the conductive pads forming a differential signal pair for differential signal transmission; a cable having a plurality of core wires soldered with the conductive pads; and an insulative body enclosing a soldering area of the conductive pads and the cable, the insulative body having a slot between the two conductive pads of the differential signal pair, the slot running through the insulative body along an up-to-down direction.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
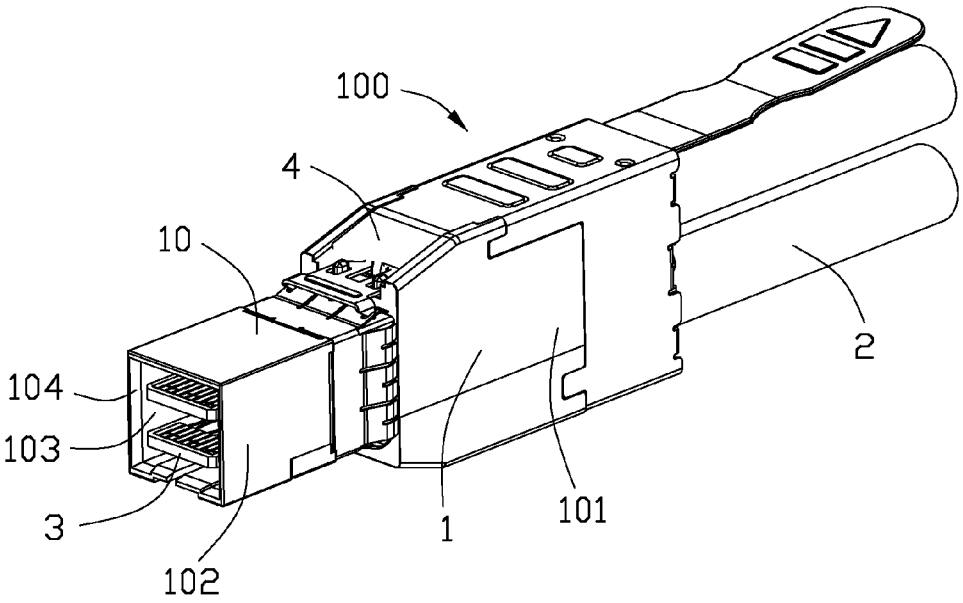
FIG. 1 is a perspective view of a cable electrical connector assembly according to the present invention.
Figure 2:
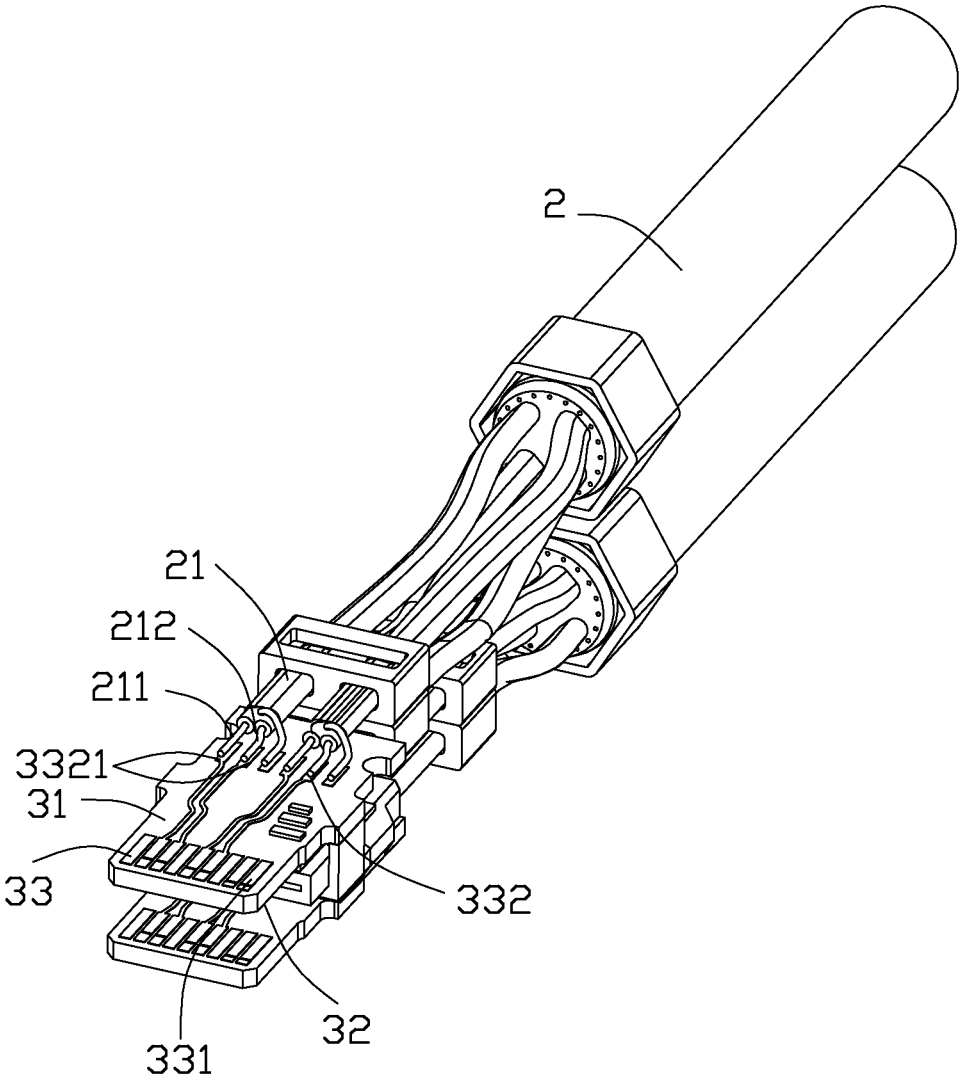
FIG. 2 is a perspective view of the cable soldered with the printed circuit board.
Figure 3:
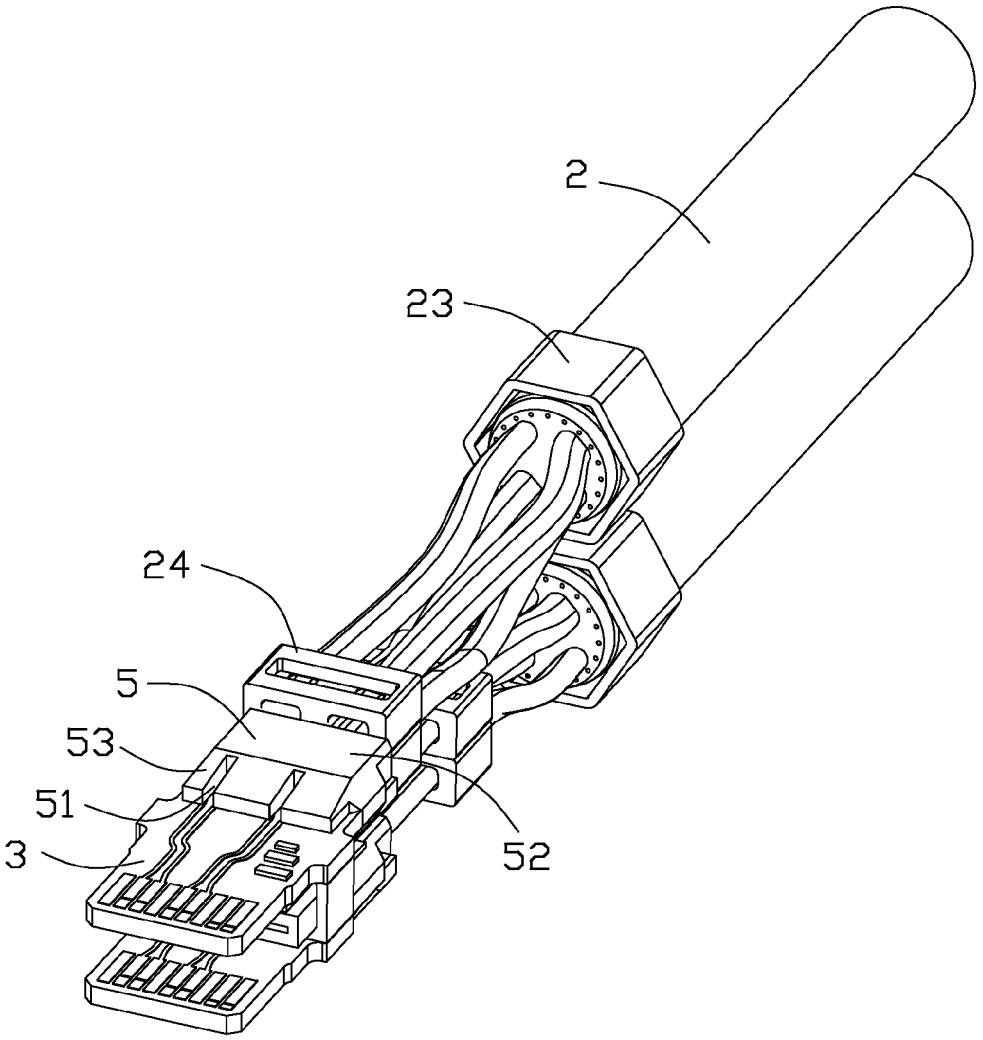
FIG. 3 is a perspective view of the insulative body enclosing the conductive pads and the core wires.

Referring to FIG. 1 to FIG. 3, a cable electrical connector assembly 100 includes an electrical connector 1 and a cable 2 connecting with the electrical connector 1. The cable 2 has a plurality of core wires 21.

The electrical connector 1 includes a housing 10, a printed circuit board 3 received in the housing 10, and an unlocking mechanism 4 mounted on the housing 10. In this embodiment, the electrical connector 1 has a pair of printed circuit boards 3. The pair of printed circuit boards 3 are spaced from each other and arranged in parallel.

The housing 10 is made of metal materials. The housing 10 has a receiving space 103 extending along a front-to-back direction and running through the housing 10. The pair of printed circuit boards 3 is received in the receiving space 103. The housing 10 defines a base 101 in the back end of the housing 10 and a mating portion 102 in the front end of the housing 10. The base 101 is thicker than the mating portion 102 in vertical direction. The housing 10 has a mating port 104 in the front end. The mating port 104 is rectangular.

The printed circuit board 3 has an obverse 31, a reverse 32, and a number of conductive pads 33 on the obverse 31 and the reverse 32. The conductive pad 33 includes a first pad 331 in the front end of printed circuit board 3 and a second pad 332 in the back end of printed circuit board 3. The first pad 331 and the second pad 332 are arranged in a transverse direction. The second pad 332 is soldered to the core wire 21.

The cable electrical connector assembly 100 further includes an insulative body 5. The insulative body 5 encloses a soldering area of the printed circuit board 3 and the core wire 21. The second pads 332 includes a differential signal pair composed of two adjacent signal pads 3321. The insulative body 5 defines a slot 51 between the two signal pads 3321. The slot 51 runs through the insulative body 5 along an upper-to-down direction. The slot 51 extends from the front end of the insulative housing 5 along a front-to-back direction. The slot 51 includes a main potion 52 and an extending potion 53. The extending portion 53 extends from the main potion 52. The slot 51 is defined on the extending portion 53. The second pads 332 and certain soldering portion of the core wires 21 are enclosed in the insulative body 5. In this embodiment, the insulative body 5 is an insulating material having a low melting point. Therefore, the insulative body is low pressure injection molded with the printed circuit board and the cable.

The cable electrical connector assembly 100 also includes a metal ring 23 far away from the soldering area of the core wire 21 and a management module 24 close to the soldering area of the core wire 21. The metal ring 23 ties the core wires 21 in bundle. The management module 24 separates the core wires 21 from each other. The core wire 21 includes a first signal conductor 211 and a second signal conductor 212. The first signal conductor 211 and the second signal conductor 212 respectively solders with the two signal pads 3321.

For protecting soldering points of the printed circuit board 3 and the cable 2, prior art designs have an insulative body 5 to enclose the soldering points. Due to some solders in soldering areas of the core wires 21 and the printed circuit board 3 and a higher dielectric constant of the insulative body, impedance increases in the soldering areas. So high frequency performance of cable electrical connector assembly 100 is affected. The present invention provides slots 51 in the insulative body 5. The slot 51 is defined between a pair of differential signal pads 3321. This design increases the impedance of the soldering area and improves the high frequency performance of cable electrical connector assembly 100.

Figure 4:
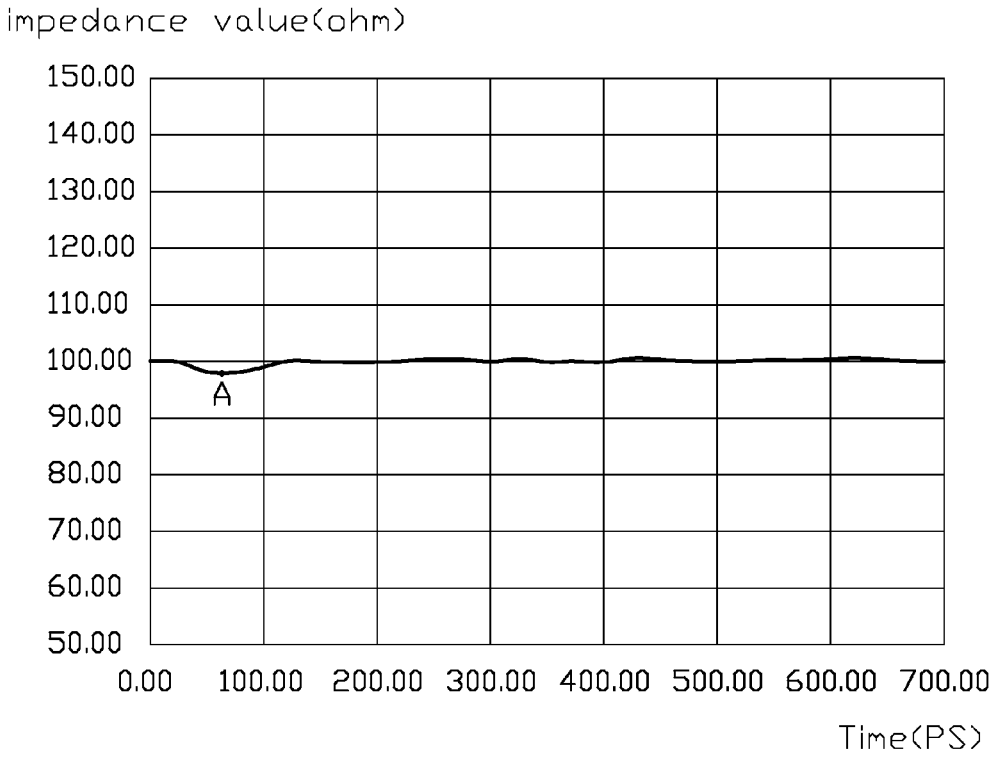
FIG. 4 is an impedance test chart of the electrical connector assembly.

FIG. 4 shows an impedance test chart of the electrical connector assembly of the present invention. The abscissa represents time (unit: ps) in the chart; the ordinate represents impedance value (unit: ohm). Minimum impedance valued is A point in the chart. When the abscissa is at 66.6667 ps in the A point, the ordinate reads 96.9354 ohm (compared to 93.0579 ohm for one prior art design). Therefore, the slot 51 provided between the differential signal pads increases the minimum impedance value of the soldering area.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A cable electrical connector assembly comprising: an electrical connector comprising a printed circuit board having a plurality of conductive pads, two of the conductive pads forming a differential signal pair for differential signal transmission; a cable having a plurality of core wires soldered with the conductive pads; and an insulative body enclosing a soldering area of the conductive pads and the cable, the insulative body having a slot between the two conductive pads of the differential signal pair, the slot running through the insulative body along an up-to-down direction; wherein the two conductive pads of the differential signal pair are located in the soldering area.

2. The cable electrical connector assembly as claimed in claim 1, wherein the insulative body comprising a main portion and an extending portion extending from the main portion, and the slot is defined on the extending portion.

3. The cable electrical connector assembly as claimed in claim 1, wherein the slot extends toward a front end of the insulative housing.

4. The cable electrical connector assembly as claimed in claim 1, wherein the insulative body is low pressure injection molded with the printed circuit board and the cable core wires.

5. The cable electrical connector assembly as claimed in claim 1, further comprising a management module for separating the core wires.

6. The cable electrical connector assembly as claimed in claim 1, wherein the electrical connector comprises a housing having a receiving space, and the printed circuit board is received in the receiving space.

7. A cable assembly comprising:

a printed circuit board having a surface defining thereon a front region and a rear region along a front-to-back direction;

a plurality of front pads formed on the front region;

a plurality of rear pads formed on the rear region and electrically connected to corresponding front pads;

a plurality of wires including inner conductors with exposed front end sections thereof mechanically and electrically connected to corresponding rear pads, respectively; and an insulative body applied upon the surface to enclose the rear pads and the exposed front end section of corresponding wires; wherein a slot is formed in the insulative body between a pair of rear pads in a transverse direction perpendicular to said front-to-back direction to increase impedance thereabouts.

8. The cable assembly as claimed in claim 7, further including a plurality of circuit traces linked between the corresponding front pads and rear pads, respectively, for establishing electrical connection therebetween.

9. The cable assembly as claimed in claim 7, wherein said insulative body is applied to the surface via a liquid form and successively solidified.

10. The cable assembly as claimed in claim 7, wherein said pair of rear pads belong to a differential pair.

11. The cable assembly as claimed in claim 7, wherein the slot extends along said front-to-back direction.

12. The cable assembly as claimed in claim 11, wherein said slot extends through the insulative body in a vertical direction perpendicular to both said front-to-back direction and said transverse direction while not through the insulative body along said front-to-back direction.

13. The cable assembly as claimed in claim 12, wherein said insulative body includes a front tapered section and a rear horizontal sections, and said slot is terminated in the front tapered section.

14. A method of assembling a cable assembly, comprising steps of:

providing a printed circuit board with a plurality of front pads and a plurality of rear pads along a front-to-back direction on a surface thereof;

providing a plurality of circuit traces on the surface to electrically connect the corresponding front pads and rear pads;

providing a plurality of wires with exposed inner conductors;

soldering said exposed inner conductor to the corresponding rear pads, respectively;

applying an insulative body upon the surface to cover the rear pads and the exposed inner conductors of the corresponding wires in a vertical direction perpendicular to said front-to-back direction; and forming a slot in said insulative body between a pair of rear pads, which belong to a differential pair, in a transverse direction perpendicular to both said front-to-back direction and said transverse direction.

15. The method as claimed in claim 14, wherein said slot extends through the insulative body in the vertical direction while not in the front-to-back direction.

* * * * *